United States Patent [19]

Maruyama

[11] Patent Number: 4,691,966

[45] Date of Patent: Sep. 8, 1987

[54] SEAT WITH GARNISHED SEAT CUSHION

[75] Inventor: Hidekazu Maruyama, Kanagawa, Japan

[73] Assignee: Ikeda Bussan Co., Ltd., Ayase, Japan

[21] Appl. No.: 878,238

[22] Filed: Jun. 25, 1986

[30] Foreign Application Priority Data

Aug. 6, 1985 [JP] Japan ..... 60-120758[U]

[51] Int. Cl.[4] ..... A47C 7/02

[52] U.S. Cl. ..... 297/452; 297/DIG. 1

[58] Field of Search ..... 297/452, 335, 443, 444, 297/DIG. 1

[56] References Cited

U.S. PATENT DOCUMENTS

| | | | |
|---|---|---|---|
| 2,107,052 | 2/1938 | Church | 297/335 |
| 3,628,830 | 12/1971 | Mitjans | 297/452 |
| 3,722,954 | 3/1973 | Rey et al. | 297/452 |
| 4,065,182 | 12/1977 | Braniff et al. | 297/452 |
| 4,275,925 | 6/1981 | Harder | 297/452 |
| 4,390,210 | 6/1983 | Wisniewski et al. | 297/452 |
| 4,493,505 | 1/1985 | Yamawaki et al. | 297/452 |

*Primary Examiner*—Francis K. Zugel

*Attorney, Agent, or Firm*—Schwartz, Jeffery, Schwaab, Mack, Blumenthal & Evans

[57] ABSTRACT

A seat cushion is mounted on a seat cushion frame in such a manner that skin member of the seat cushion covers a front portion of the seat cushion frame. A zig-zag structure is secured to the front portion of the frame to provide near the front portion of the frame an outwardly projected portion. A garnish of deformable material is arranged to conceal unsightly portions of the frame and the seat cushion and is formed with a groove into which the outwardly projected portion is snugly received thereby tightly supporting the front portion of the garnish to the frame.

8 Claims, 8 Drawing Figures

SEAT WITH GARNISHED SEAT CUSHION

BACKGROUND OF THE INVENTION

1. Field of the Invention

The present invention relates in general to a seat, and more particularly to a seat having a garnished seat cushion. More specifically, the present invention is concerned with a seat cushion assembly which is decorated with an easily assembled garnish.

2. Description of a Prior Art

In order to clarify the task of the present invention, one conventional seat of the above-mentioned type will be outlined with reference to FIG. 8 which shows a so-called "jump seat" 100 which is installed in a driver's cabin of a truck or the like for use as an extra seat. The seat 100 comprises a rectangular seat cushion frame supported through a known hinge mechanism 102 on a rear wall 104 of the driver's cabin, a seat back 106 pivotally mounted to a rear portion of the seat cushion frame and a cushion pad 108 mounted on the seat cushion frame. By the provision of the hinge mechanism 102, the seat cushion is pivotally movable together with the seat back 106 between the illustrated horizontal "in-use" position and an upright "not in-use" position. The seat cushion frame is decorated with a tray-shaped plastic garnish 110 which is attached to the lower portion of the seat cushion to conceal unsightly portions of the same. The garnish 110 is secured at its side walls to the seat cushion frame by suitable fasteners 112, such as bolts or clips.

However, long use of the seat 100 tends to induce a permanent downward deformation (see the arrow D) of the front portion of the garnish 110 because of considerable stress frequently applied thereto by the femoral portions of a seat occupant. This phenomenon deteriorates the external appearance of the seat. This undesirable deformation of the garnish 110 becomes more severe when the front portion of the garnish 110 is largely protruded from the seat cushion frame.

SUMMARY OF THE INVENTION

It is therefore an essential object of the present invention to provide a seat with a garnished seat cushion assembly which is free of the above-mentioned drawback.

According to the present invention, there is provided a seat cushion assembly decorated with a garnish the front portion of which is tightly supported by the seat cushion frame through a garnish supporter.

According to the present invention, there is provided a seat cushion assembly of a seat, which comprises a generally rectangular frame including a front portion, two side portions and a rear portion; a seat cushion including a cushion material and a skin member which covers the cushion material, the seat cushion being mounted on the frame with the skin member covering the front portion of the frame; a zig-zag wire of resilient material including a first series of protrusions protruding in one direction, a second series of protrusions protruding in the other direction and intermediate portions interconnecting the first and second series of protrusions, the second series of protrusions being secured to the front portion of the frame having the first series of protrusions pressed against a rear surface of the skin member thereby to provide the skin member with a plurality of outwardly raised portions; a generally rectangular garnish of plastics arranged to conceal unsightly portions of the frame and the seat cushion, the garnish including a rectangular flat portion and a bank portion extending along the rectangular periphery of the flat portion, the bank portion being formed at the inboard side therewith with a longitudinally extending recess into which the outwardly raised portions of the skin member are snugly received; and connecting means connecting at least a portion of the garnish other than the recessed portion of the bank portion of the garnish to the frame.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the term "forward" or "rearward" is to be understood as referring to "in the direction of the front or rear of a seat with which a garnished seat cushion assembly of the present invention is practically applied".

Figure 1:
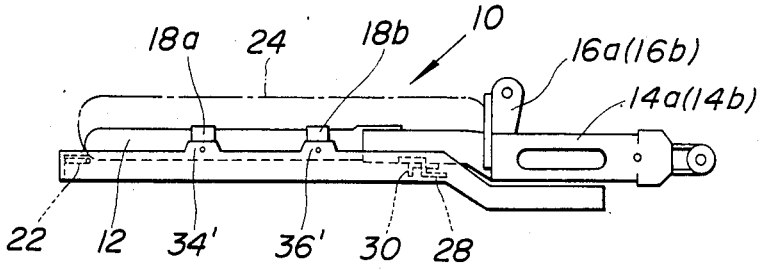
FIG. 1 is a side view of a garnished seat cushion assembly of a seat according to the present invention.
Figure 2:
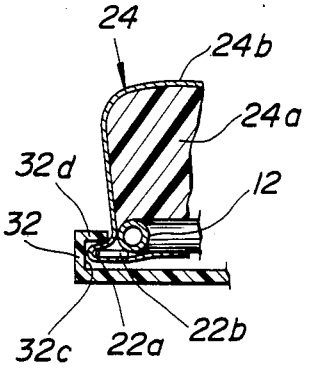
FIG. 2 is an enlarged axially sectional view of a front portion of the seat cushion assembly.

Referring to FIGS. 1 and 2, particularly FIG. 1, there is shown a garnished seat cushion assembly 10 according to the present invention.

Figure 4:
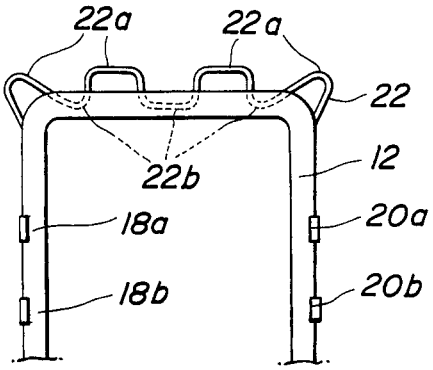
FIG. 4 is a plan view of a front portion of seat cushion frame with a garnish supporter fixed thereto.

The assembly 10 comprises a generally rectangular frame 12, two parallel arms 14*a* and 14*b* respectively secured to lateral side portions of the frame 12 and extending rearward therefrom. Designated by numerals 16*a* and 16*b* are brackets which are secured to a rear portion of the frame 12 for pivotally mounting thereon a seat back 54 as may be seen from FIG. 7. As is seen from FIG. 4, the frame 12 is provided at each side portion with two brackets 18*a* and 18*b* (or 20*a* and 20*b*) for the purpose which will be clarified hereinafter. Furthermore, a front portion of the frame 12 has a garnish supporter 22 secured thereto. The garnish supporter 22 is in the form of a zig-zag wire of a resilient material or the like, which thus comprises a first series of protrusions 22*a* protruding in one direction, a second series of protrusions 22*b* protruding in the other direction and intermediate portions (no numerals) interconnecting the first and second series of protrusions 22*a* and 22*b*. As is understood from FIGS. 2 and 4, the zig-zag wire 22 is secured or welded at the second series of protrusions 22*b* to the lower surface of the front portion of the frame 12 having the first series of protrusions 22*a* projected forward. A cushion pad 24 mounted on the frame 12 comprises a cushion material 24*a* covered with a skin nember 24*b*. As is seen from FIG. 2, upon assembly, the cushion pad 24 is mounted on the frame 12 having the garnish supporter 22 thrust into the lower portion of the skin member 24*b* of the cushion pad 24. With this, the lower portion of the skin member 24*b* becomes to have a series of outwardly raised portions which are the traces of the first series of the protrusions 22*a* of the garnish supporter 22. If desired, the lower portion of the skin member 24*b* may be formed with openings 24*c* through which the first series of protrusions 22*a* of the garnish supporter 22 are projected outwardly.

Figure 6:
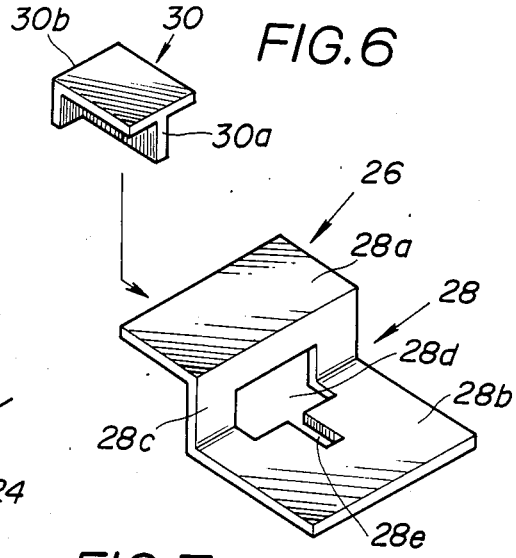
FIG. 6 is a perspective view of a fastener in disassembled condition, by which a rear portion of the garnish is fastened to the seat cushion frame.
Figure 8:
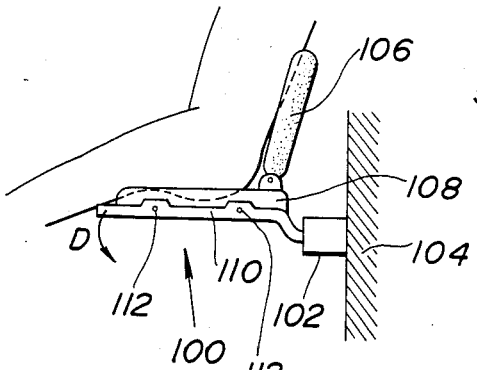
FIG.8 (Prior Art)
FIG. 8 is a side view of the conventional folding seat which has been described hereinabove.

Referring to FIG. 6, a fastener 26 is shown which, as will become apparent hereinafter, functions to detachably connect a rear portion of a next-mentioned garnish 32 to the seat cushion frame 12. The fastener 26 comprises a catch member 28 which is secured to the the rear portion of seat cushion frame 12 (see FIG. 1) and a key member 30 which is secured to the rear portion of the garnish 32 and lockably engageable with the catch member 28. As is seen from FIG. 6, the catch member 28 is in the form of a stepped member, which thus includes a flat base portion 28*a*, a flat lug portion 28*b* and an intermediate portion 28*c* which interconnects the base and lug portions 28*a* and 28*b*. A key hole 28*d* is formed in the catch member 28, which extends between the lug portion 28*b* and the intermediate portion 28*c*. The lug portion 28*b* has a slot 28*e* merged with the key hole 28*d*. As may be understood from FIG. 1, the catch member 28 is secured at the flat base portion 28*a* to the rear portion of the seat cushion frame 12 with the flat lug portion 28*b* extending rearward. The key member 30 which is lockably engageable with the catch member 28 comprises a key portion 30*a* having a generally T-shaped cross section and a base portion 30*b* integral with the key portion 30*a*. The key member 30 is secured at the base portion 30*b* to the garnish 32.

Figure 3:
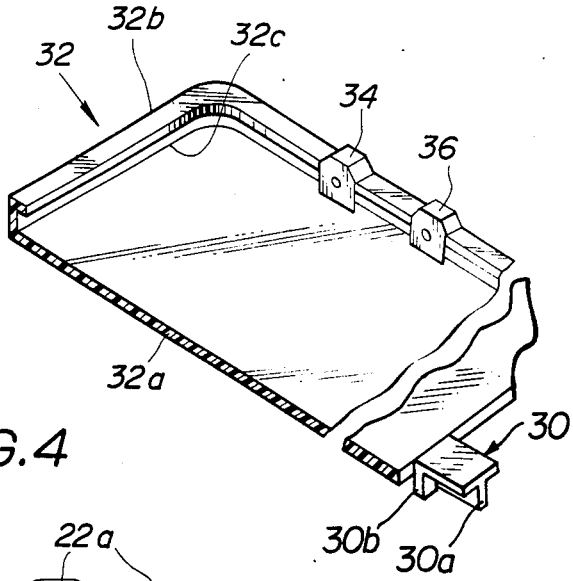
FIG. 3 is a partially sectional view of a plastic garnish employed in the present invention.

As is seen from FIG. 3, the garnish 32 adapted to cover the lower unsightly part of the seat cushion assembly is in the form of a rectangular tray, which thus comprises a rectangular flat portion 32*a* and a bank portion 32*b* extending along the rectangular periphery of the flat portion 32*a* and integral thereto. The bank portion 32*b* is formed at the inboard side with a groove 32*c*, leaving an inwardly projecting flange portion 32*d* as may be well understood from FIG. 2. The bank portion 32*b* is formed at each side portion thereof with two enlarged portions 34 and 36 each having a bolt hole (no numeral) formed therethrough. As is seen from FIG. 1, the key member 30 is secured at its base portion 30*b* to a rear portion of the garnish 32 with the key portion 30*a* extending rearward.

Figure 5:
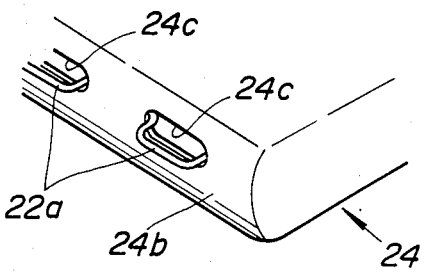
FIG. 5 is a perspective view showing the garnish supporter having protrusions projected outwardly through openings formed in a skin member of a cushion pad.

Upon assembly, the garnish 32 is attached to the back side of the seat cushion frame 12 in such a manner that the outwardly raised portions of the skin member 24*b* are snugly received in the groove 32*c* formed in the front bank portion 32*b* of the garnish 32 and at the same time the key member 30 is lockingly engaged with the catch member 28 having the key portion 30*a* lockingly put into the key hole of the catch member 28. Under finally set position of the garnish 32, the unsightly lower and bank portions of the seat cushion assembly 10 are concealed by the garnish 32 and the enlarged portions 34 and 36 of the bank portion 32*b* are mated with the corresponding brackets 18*a* and 18*b* of the seat cushion frame 12, as will be understood from FIG. 1. Then, bolts are inserted into the holes of the enlarged portions 34 and 36 and turned to tightly secure the garnish 32 to the seat cushion frame 12. In case of the modification shown in FIG. 5, the first series of protrusions 22*a* of the garnish supporter 22 are received in the groove 32*c* of the garnish 32.

It is to be noted that since the front portion of the garnish 32 is supported directly (FIG. 5) or indirectly (FIG. 2) by the garnish supporter 22 secured to the frame 12, the afore-mentioned undesirable phenomenon (that is, the permanent downward deformation of the front portion of the garnish 32) does not occur.

Figure 7:
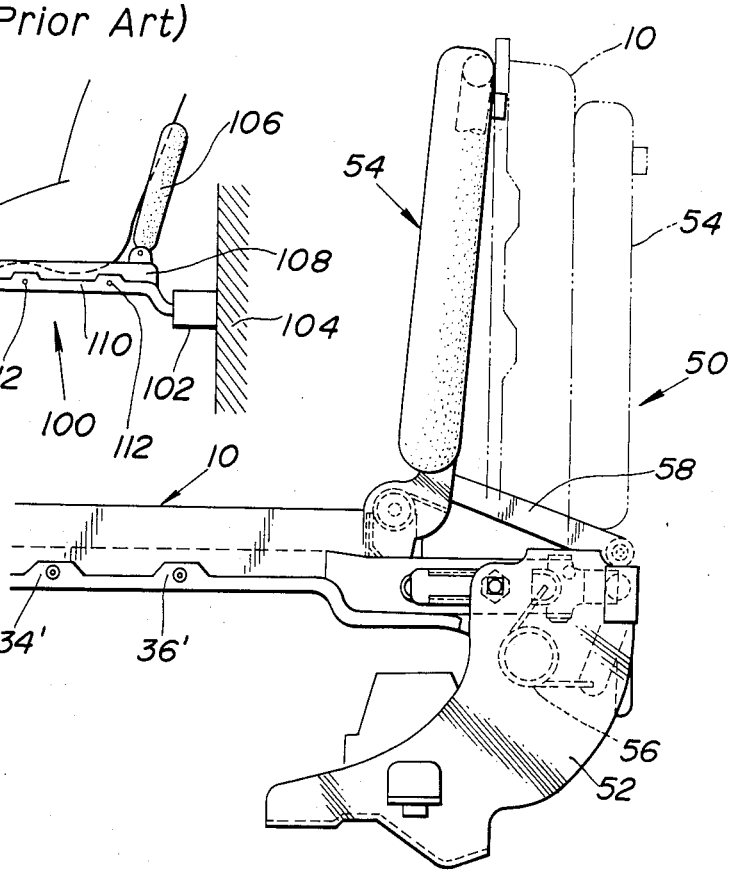
FIG. 7 is a side view of a folding seat to which the garnished seat cushion assembly is practically applied.

Referring to FIG. 7, there is shown a so-called jump seat 50 to which the above-mentioned garnished seat cushion assembly 10 is practically applied. The seat 50 is described in U.S. patent application filed Apr. 8, 1986 in the name of Hidekazu MARUYAMA, which comprises a base structure 52 mounted on a floor of a driver's cabin. The garnished seat cushion assembly 10 is pivotally connected at its rear portion to the base structure 52. A seat back 54 is pivotally mounted on a rear portion of the seat cushion assembly 10. A coil spring 56 is arranged between the seat cushion assembly 10 and the base structure 52 and a link mechanism 58 is arranged between the seat back 54 and the base structure 52. The seat cushion assembly 10 is thus pivotal between a horizontal "in-use" position as illustrated by a solid line and an upright "not in-use" position as illustrated by a phantom line. The coil spring 56 is arranged to bias the seat cushion assembly 10 toward the "in-use" position when the assembly 10 is in a first angular range including the "in-use" position, and to bias the seat cushion assembly 10 toward the "not in-use" position when the assembly 10 is in a second angular range including the "not in-use" position. Thus, once the seat cushion assembly 10 is pivoted down or up to a predetermined angular position, the same is thereafter automatically pivoted to a desired "in-use" position or "not in-use" position thereof thereby facilitating handling of the seat.

What is claimed is:

1. A seat cushion assembly of a seat, comprising:

a generally rectangular frame including a front portion, two side portions and a rear portion;

a seat cushion including a cushion material and a skin member which covers said cushion material, said seat cushion being mounted on said frame with said skin member covering said front portion of said frame;

a zig-zag wire of resilient material including a first series of protrusions protruding in one direction, a second series of protrusions protruding in the other direction and intermediate portions interconnecting the first and second series of protrusions, said second series of protrusions being secured to said front portion of the frame having said first series of protrusions pressed against a rear surface of said skin member, thereby to provide the skin member with a plurality of outwardly raised portions;

a generally rectangular garnish of plastics arranged to conceal portions of said frame and said seat cushion, said garnish including a rectangular flat portion and a bank portion, said bank portion being formed at the inboard side thereof with a recess into which said outwardly raised portions of said skin member are snugly received, said recess extending in a direction generally parallel to said front frame portion; and connecting means for connecting at least a portion of said garnish other than the recessed portion or the bank portion of the garnish to said frame.

2. A seat cushion assembly as claimed in claim 1, further comprising a fastener which detachably fastens a portion of said garnish to said frame when said outwardly projected portion is snugly received in said recess of said garnish.

3. A seat cushion assembly as claimed in claim 2, in which said fastener comprises a catch member secured to said frame and a key member secured to said garnish, said catch member being formed with a key hole with which said key member is lockably engageable.

4. A seat cushion assembly as claimed in claim 1, wherein said plurality of raised portions extend forwardly and said recess opens rearwardly.

5. A seat cushion as claimed in claim 4, wherein said bank portion is coextensive with at least said front portion of the frame, said bank portion being raised relative to said rectangular flat portion and including a flange, said recess being defined between said flange and said flat portion, whereby upon use of the seat, engagement between said flange and said plurality of outwardly raised portions reduces downward deformation of said coextensive bank portion.

6. A seat cushion assembly as claimed in claim 1, wherein said connecting means comprises:

a bracket formed on each side portion of said frame;

an enlarged portion formed on each side portion of said garnish; and a bolt connecting said bracket and said enlarged portion.

7. A seat cushion assembly as claimed in claim 4, wherein said bank portion is coextensive with at least said front portion of said frame, said bank portion being raised relative to said rectangular flat portion and including a flange, said recess being defined between said flange and said flat portion, said skin member of said cushion being formed, at the portion thereof covering the front portion of the frame, with a plurality of openings so that the first series of protrusions of the zig-zag wire extend outwardly through said openings of said skin member, whereby upon use of the seat, engagement between said flange and said first series of protrusions reduces downward deformation of said coextensive bank portion.

8. A seat cushion assembly as claimed in claim 7, wherein said connecting means comprises:

a bracket formed on each side portion of said frame;

an enlarged portion formed on each side portion of said garnish; and a bolt connecting said bracket and said enlarged portion.

* * * * *